US008188660B2

(12) United States Patent
Kanda

(10) Patent No.: US 8,188,660 B2
(45) Date of Patent: May 29, 2012

(54) PLASMA DISPLAY PANEL HAVING IMPROVED BRIGHTNESS AND BRIGHT ROOM CONTRAST

(75) Inventor: Hiroshi Kanda, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 217 days.

(21) Appl. No.: 12/461,097

(22) Filed: Jul. 31, 2009

(65) Prior Publication Data

US 2010/0045161 A1 Feb. 25, 2010

(30) Foreign Application Priority Data

Aug. 21, 2008 (KR) ..... 10-2008-0081856

(51) Int. Cl.
*H01J 17/49* (2006.01)

(52) U.S. Cl. ..... 313/582

(58) Field of Classification Search ..... None
See application file for complete search history.

(56) References Cited

U.S. PATENT DOCUMENTS 6,100,633 A * 8/2000 Okumura et al. ..... 313/486
6,670,754 B1 * 12/2003 Murai et al. ..... 313/582
6,873,103 B2 * 3/2005 Takada et al. ..... 313/582
2007/0046194 A1 3/2007 Lee

FOREIGN PATENT DOCUMENTS

KR 10-2007-0014441 A 2/2007
KR 10-2007-0026954 A 3/2007

* cited by examiner

*Primary Examiner* — Toan Ton
*Assistant Examiner* — Britt D Hanley
(74) *Attorney, Agent, or Firm* — Lee & Morse, P.C.

(57) ABSTRACT

A plasma display panel including a first substrate and a second substrate, the first substrate having an inner surface facing the second substrate, at least one dark-colored visible ray absorbing layer on the inner surface of the first substrate, at least one discharge sustaining electrode pair on the visible ray absorbing layer, a first dielectric layer on the discharge sustaining electrode pair, an address electrode on the second substrate and disposed in a direction crossing the discharge sustaining electrode pair, a second dielectric layer on the address electrode, barrier ribs disposed between the first substrate and the second substrate and defining a plurality of discharge cells, and a phosphor layer coated in the discharge cells.

12 Claims, 6 Drawing Sheets

PLASMA DISPLAY PANEL HAVING IMPROVED BRIGHTNESS AND BRIGHT ROOM CONTRAST

BACKGROUND

1. Technical Field

Embodiments relate to a plasma display panel (PDP).

2. Description of the Related Art

A plasma display panel (PDP) is a flat panel display device that displays images by using a method in which a discharge gas is sealed between substrates in which a plurality of discharge electrodes are patterned. The discharge gas may emit light by applying a voltage to the discharge electrodes and an address electrode.

A conventional three-electrode alternating current type surface discharge type PDP may include a first substrate; a second substrate; discharge sustaining electrode pairs each having an X electrode and a Y electrode on an inner surface of the first substrate; a first dielectric layer on the discharge sustaining electrode pairs; a protective film layer on a surface of the first dielectric layer; a plurality of address electrodes on an inner surface of the second substrate and disposed in a direction crossing the discharge sustaining electrode pairs; a second dielectric layer on the address electrodes; barrier ribs between the first substrate and the second substrate to define discharge cells; and red, green, and blue phosphor layers formed in the discharge cells.

A conventional X electrode may include an X transparent electrode including a transparent material, e.g., an indium tin oxide (ITO) film; and an X bus electrode electrically connected to the X transparent electrode and including a metal material, e.g., an Ag paste. A conventional Y electrode may include a Y transparent electrode and a Y bus electrode electrically connected to the Y transparent electrode.

A discharge region may be formed by injecting a discharge gas between the first and second substrates, and frit glass may be coated along edges of surfaces of the first and second surfaces, which face each other, in order to seal the discharge space from the outside.

In the conventional three-electrode alternate current type surface discharge type PDP having the above structure, discharge cells may be selected by applying an electrical signal to the Y electrode and the address electrode. Then, ultraviolet rays may be generated from a surface of the first substrate by alternately applying an electrical signal to the X and Y electrodes. Thus, an image may be realized using visible light emitted from the phosphor layers of the selected discharge cells.

Since red, green, and blue phosphor layers may externally exhibit a white color, the red, green and blue phosphor layers may have high reflectivity with respect to visible rays. External light, which may enter through the first substrate to be incident on a discharge cell, may be reflected by the red, green, and blue phosphor layers exhibiting white color, may be transmitted through the X transparent electrode and the Y transparent electrode, and then may be transmitted through the first substrate to outside the PDP. Thus, since the reflected light may be viewed together with light emitted from a panel, when viewed in a bright room, the bright room contrast of the PDP may be reduced.

SUMMARY

Embodiments are therefore directed to a plasma display panel, which substantially overcomes one or more of the problems due to the limitations and disadvantages of the related art.

It is therefore a feature of an embodiment to provide a PDP having improved bright room contrast.

It is therefore another feature of an embodiment to provide a PDP having improved brightness.

At least one of the above and other features and advantages may be realized by providing a plasma display panel (PDP), including a first substrate and a second substrate, the first substrate having an inner surface facing the second substrate, at least one dark-colored visible ray absorbing layer on the inner surface of the first substrate, at least one discharge sustaining electrode pair on the visible ray absorbing layer, a first dielectric layer on the discharge sustaining electrode pair, an address electrode on the second substrate and disposed in a direction crossing the discharge sustaining electrode pair, a second dielectric layer on the address electrode, barrier ribs disposed between the first substrate and the second substrate and defining a plurality of discharge cells, and a phosphor layer coated in the discharge cells.

The visible ray absorbing layer may be disposed directly on the inner surface of the first substrate and the discharge sustaining electrode pair may be disposed directly on the visible ray absorbing layer.

Each discharge sustaining electrode pair may include an X electrode and a Y electrode in one of the discharge cells, and the visible ray absorbing layer may include an X electrode visible ray absorbing layer and a Y electrode visible ray absorbing layer corresponding to the X electrode and the Y electrode, respectively.

The X electrode and the Y electrode may extend in a direction crossing the address electrode and an adjacent discharge cell, and the X electrode visible ray absorbing layer and the Y electrode visible ray absorbing layer may overlie the X electrode and the Y electrode, and extend in the same direction as the X electrode and the Y electrode.

The visible ray absorbing layer may have a black color and include glass.

The discharge sustaining electrode pair may include at least one of aluminum, gold, silver, tungsten, chromium, nickel and an alloy including at least one of aluminum, gold, silver, tungsten, nickel, and chromium.

Each visible ray absorbing layer and each discharge sustaining electrode of a discharge sustaining electrode pair may include a first edge, and the first edge of the visible ray absorbing layer may be aligned with the first edge of the discharge sustaining electrode in a discharge cell.

The PDP may include a plurality of discharge sustaining electrode pairs, each having at least a pair of electrodes, at least one discharge sustaining electrode pair being adjacent to another discharge sustaining electrode pair, the PDP may further include a non-discharge region defined by a space between one discharge sustaining electrode pair and the other adjacent discharge sustaining electrode pair, and the visible ray absorbing layer and the discharge sustaining electrodes may each have a width, and the width of the visible ray absorbing layer may be greater than the width of each discharge sustaining electrode.

Each discharge sustaining electrode pair may include an X electrode and a Y electrode in a discharge cell, and the visible ray absorbing layer may overlie the non-discharge region and the X electrode and Y electrode in different, adjacent discharge cells.

The PDP may further include a reflective layer on the second substrate.

At least one of the above and other features and advantages may also be realized by providing a PDP, including a substrate having an inner surface, a dark-colored visible ray absorbing layer on the inner surface of the substrate, a reflective layer on the visible ray absorbing layer, a dielectric layer on the reflective layer, and a discharge space adjacent to the dielectric layer.

The reflective layer may face the discharge space and include a reflective conductive material to which a predetermined discharge voltage may be applied.

The reflective layer may include at least one of aluminum, gold, silver, tungsten, chromium, nickel and an alloy including at least one of aluminum, gold, silver, tungsten, nickel, and chromium.

The visible ray absorbing layer may have a black color and include glass.

The discharge space may include barrier ribs partitioning the discharge space into discharge cells, the reflective layer may extend in a direction to cross adjacent discharge cells, the visible ray absorbing layer may overlie the reflective layer and extends in the same direction as the reflective layer, and the visible ray absorbing layer and the reflective layer may be stacked in a two-layer structure.

The visible ray absorbing layer and the reflective layer may each have a first edge, and the first edge of the visible ray absorbing layer may be aligned with the first edge of the reflective layer in the discharge cells.

The visible ray absorbing layer and the reflective layer may each have a width, and the width of the visible ray absorbing layer may be greater than the width of the reflective layer.

BRIEF DESCRIPTION OF THE DRAWINGS

The above and other features and advantages will become more apparent to those of ordinary skill in the art by describing in detail exemplary embodiments thereof with reference to the attached drawings, in which.

DETAILED DESCRIPTION

Figure 1:
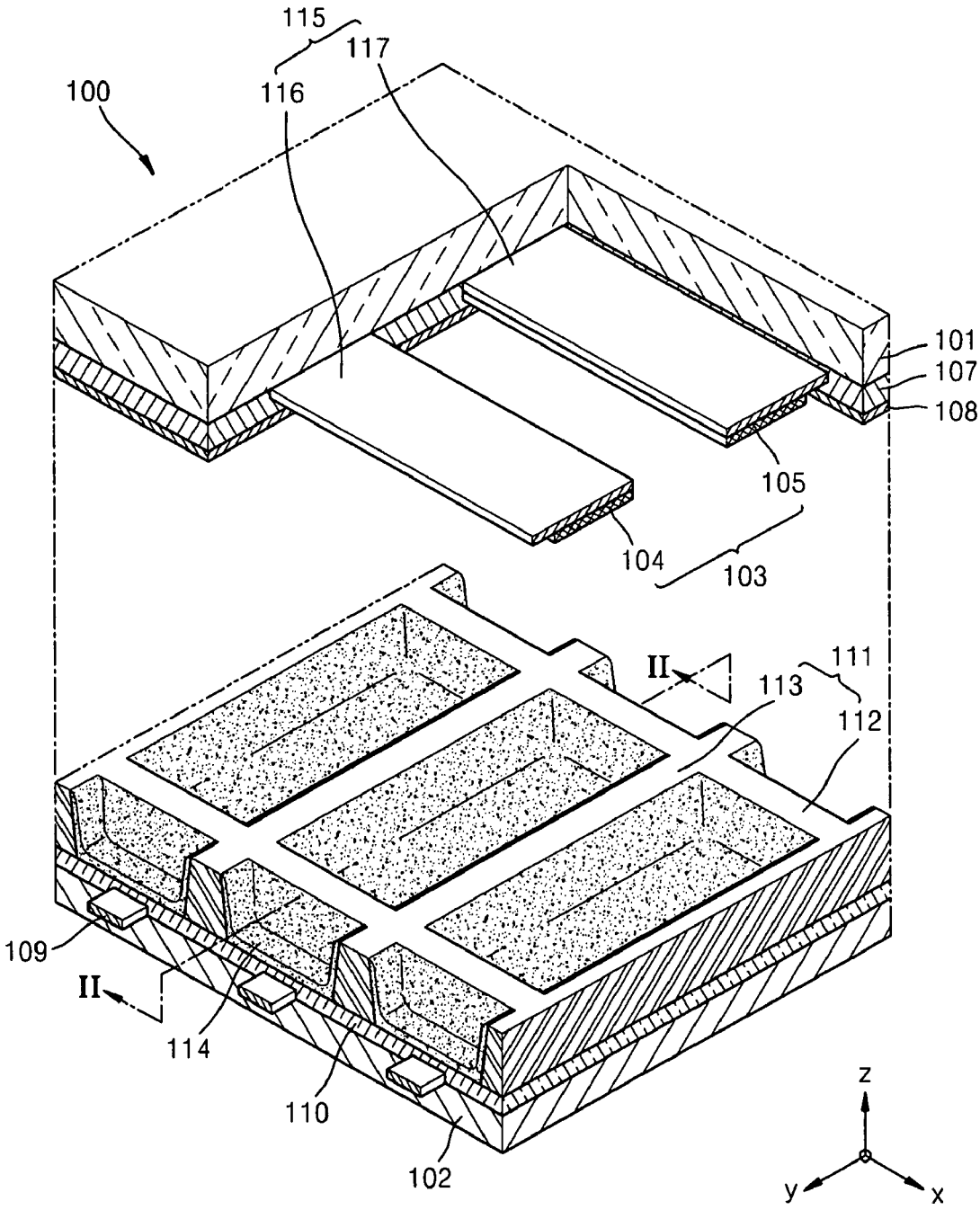
FIG. 1 illustrates a cut-away exploded perspective view of a plasma display panel (PDP) according to an embodiment.

Korean Patent Application No. 10-2008-0081856, filed on Aug. 21, 2008, in the Korean Intellectual Property Office, and entitled: "Plasma Display Panel," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

As used herein, the expression "or" is not an "exclusive or" unless it is used in conjunction with the term "either." For example, the expression "A, B, or C" includes A alone; B alone; C alone; both A and B together; both A and C together; both B and C together; and all three of A, B, and C together, whereas the expression "either A, B, or C" means one of A alone, B alone, and C alone, and does not mean any of both A and B together; both A and C together; both B and C together; and all three of A, B, and C together.

As used herein, the terms "a" and "an" are open terms that may be used in conjunction with singular items or with plural items. For example, the term "a metal" may represent a single compound, e.g., aluminum, or multiple compounds in combination, e.g., aluminum mixed with gold.

Figure 2:
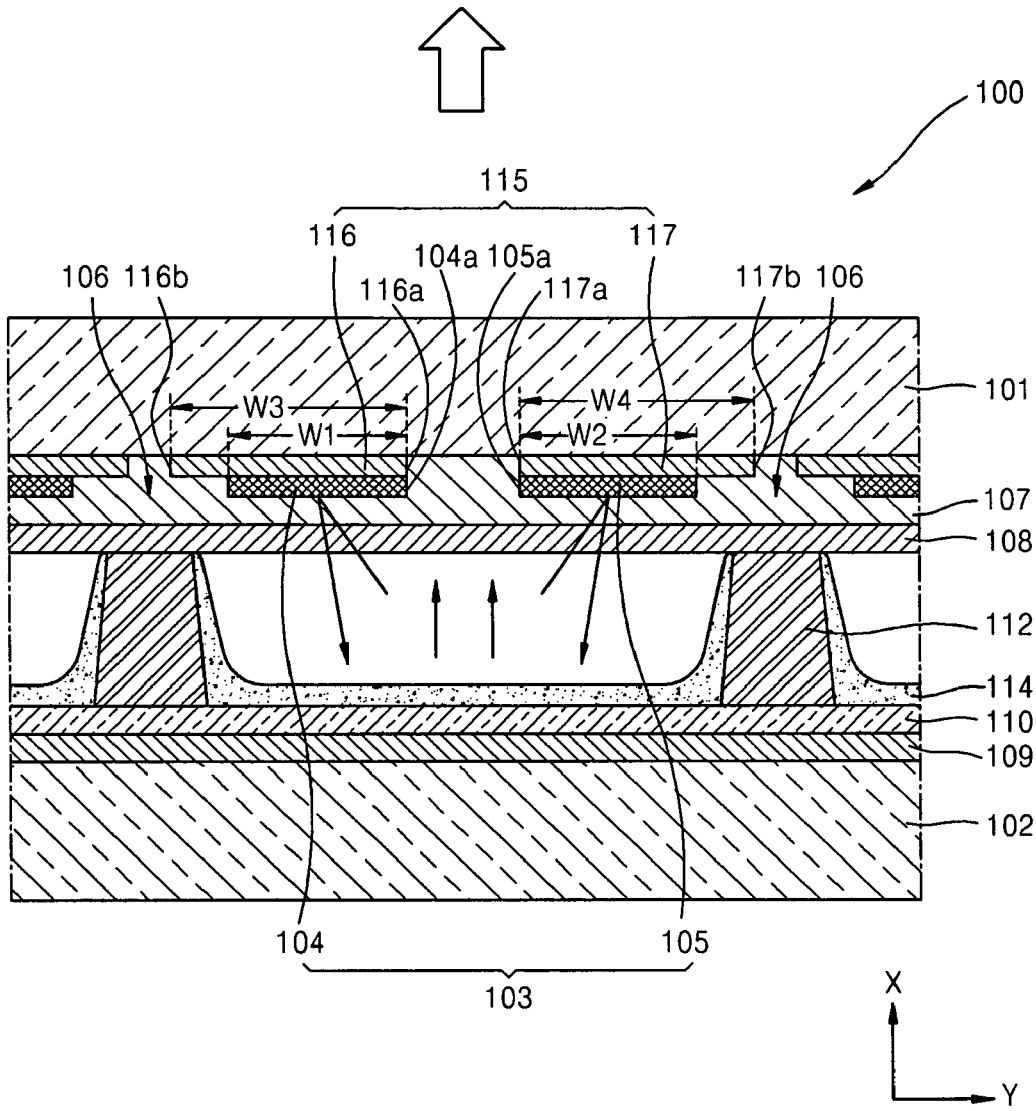
FIG. 2 illustrates a cross-sectional view of the PDP taken along a line II-II of FIG. 1.

FIG. 1 illustrates a cut-away exploded perspective view of a plasma display panel (PDP) 100 according to an embodiment. FIG. 2 illustrates a cross-sectional view of the PDP 100 taken along a line II-II of FIG. 1.

Referring to FIGS. 1 and 2, the PDP 100 may include a first substrate 101, and a second substrate 102 facing the first substrate 101. A sealing material (not shown), e.g., frit glass, may be coated along inner edges of the first substrate 101 and the second substrate 102, which face each other. The sealing material may seal a discharge space from the outside when the first substrate 101 and the second substrate 102 are coupled to each other.

The first substrate 101 may be a transparent substrate formed of, e.g., soda lime glass, etc. Discharge sustaining electrode pairs 103 may be disposed on an inner surface of the first substrate 101. Each of the discharge sustaining electrode pairs 103 may include an X electrode 104 and a Y electrode 105, which may be disposed in an x direction. Each discharge cell may correspond to a pair of an X electrode 104 and a Y electrode 105. X electrodes 104 and Y electrodes 105 may be alternately disposed along the first substrate 101 in a y direction.

A non-discharge region 106 (FIG. 2) may be defined by a space between the pair of discharge sustaining electrode pairs 103 in a first discharge cell and another pair of discharge sustaining electrodes 103 in another discharge cell adjacent to the first discharge cell. An insulating black stripe layer may be formed on the non-discharge region 106 in order to improve the contrast of the PDP 100.

The discharge sustaining electrode pairs 103 may be covered by a first dielectric layer 107. The first dielectric layer 107 may include a glass paste containing various fillers.

A protective layer 108 may include, e.g., magnesium oxide (MgO), and may be disposed on a surface of the first dielectric layer 107 in order to, e.g., prevent damage to the first dielectric layer 107 and obtain a higher secondary electron emission yield.

The second substrate 102 may include substantially the same material as that of the first substrate 101, and the material of the second substrate 102 may vary according to whether the PDP 100 is a transmissive type or a reflective type.

Address electrodes 109 may be disposed on the inner surface of the second substrate 102. The address electrodes 109 may intersect with the Y electrode 105. The address electrodes 109 may be covered by a second dielectric layer 110.

Barrier ribs 111 may be formed between the first substrate 101 and the second substrate 102 to define discharge cells together with the first substrate 101 and the second substrate 102. The barrier ribs 111 may include first barrier ribs 112 intersecting the address electrodes 109, and second barrier ribs 113 parallel to the address electrodes 109. Since the first barrier ribs 112 and the second barrier ribs 113 may be arranged in rows and columns, the barrier ribs 111 may be formed in a matrix pattern.

Alternatively, the barrier ribs 111 may be formed in, e.g., a meander pattern, a delta pattern, or a honeycomb pattern. In this case, the discharge cells defined by the barrier ribs 111 may have, e.g., polygonal, circular, or oval cross-sections.

Red, green, and blue phosphor layers 114 may be coated in the discharge cells formed by the barrier ribs 111 and emit light to display an image during a discharge. The red phosphor layers may include, e.g., $(Y,Gd)BO_3;Eu^{+3}$, the green phosphor layers may include, e.g., $Zn_2SiO_4:Mn^{2+}$, and the blue phosphor layers may include, e.g., $BaMgAl_{10}O_{17}:Eu^{2+}$.

A discharge gas, e.g., neon (Ne)-xenon (Xe) or helium (He)-xenon (Xe), may be injected into the discharge cells defined by the first substrate 101, the second substrate 102, and the barrier ribs 111.

The discharge sustaining electrode pair 103 may function as a reflective layer. A plurality of visible ray absorbing layers 115 may be formed between the first substrate 101 and the discharge sustaining electrode pairs 103.

The X electrodes 104 may extend on the first substrate 101 in the x direction to cross adjacent discharge cells, and may be disposed in a stripe pattern. The Y electrodes 105 may also extend on the first substrate 101 in the x direction to cross adjacent discharge cells and may be disposed in a stripe pattern.

The X electrodes 104 may be symmetric with respect to the Y electrodes 105. The X electrodes 104 and the Y electrodes 105 may be disposed to face each other in each discharge cell. A discharge gap may be between the X electrode 104 and the Y electrode 105. The structures of the X electrodes 104 and the Y electrodes 105 are not limited to a stripe pattern as long as the X electrodes 104 and the Y electrodes 105 are disposed to face each other in each discharge cell, and thus the X electrode 104 and the Y electrode 105 may have various patterns.

The X electrodes 104 and the Y electrodes 105 may include, e.g., a reflective material having high reflectivity, i.e., about 80% or more of visible rays emitted by exciting a phosphor material of the red, green, and blue phosphor layers 114 may be reflected back into the discharge cells, as indicated by an arrow in FIG. 2. The reflective material of the X electrode 104 and the Y electrode 105 may include, e.g., aluminum, gold, silver, tungsten, chromium, nickel and an alloy including, e.g., aluminum, gold, silver, tungsten, chromium, and nickel, as long as the reflectivity of the reflective material is equal to or greater than about 80% with respect to the visible rays.

The visible ray absorbing layers 115 may be formed between the first substrate 101 and the discharge sustaining electrode pairs 103. The visible ray absorbing layer 115 may include an X electrode visible ray absorbing layer 116, corresponding to the X electrode 104, and may be interposed between the first substrate 101 and the X electrode 104. The visible ray absorbing layer 115 may also include a Y electrode visible absorbing layer 117, corresponding to the Y electrode 105, and may be interposed between the first substrate 101 and the Y electrode 105.

A bottom surface of the X electrode visible ray absorbing layer 116 and a bottom surface of the Y electrode visible absorbing layer 117 may be in contact with the inner surface of the first substrate 101. An upper surface of the X electrode visible ray absorbing layer 116 and an upper surface of the Y electrode visible absorbing layer 117 may be in contact with the bottom surface of the X electrode 104 and the bottom surface of the Y electrode 105, respectively.

Accordingly, in the PDP 100, the visible ray absorbing layers 115 may constitute a first layer on the inner surface of the first substrate 101. The discharge sustaining electrode pairs 103 may constitute a second layer on the visible ray absorbing layers 115.

The X electrode visible ray absorbing layer 116 and the Y electrode visible absorbing layer 117 may be formed in, e.g., a stripe pattern, as in the case of the X electrode 104 and the Y electrode 105. The X electrode visible ray absorbing layer 116 and the Y electrode visible absorbing layer 117 may extend on the first substrate 101 in the x direction parallel to the X electrode 104 and the y electrode 105, crossing adjacent discharge cells.

The X electrode 104 and the Y electrode 105 may each have a first edge 104*a* and 105*a*, and the first edge 104*a* of the X electrode 104 of a discharge sustaining electrode pair 103 may face the first edge 105*a* of the Y electrode 105 of a discharge sustaining electrode pair 103 in a discharge cell. A first edge 116*a* of the X electrode visible ray absorbing layer 116 may be aligned with the first edge 104*a* of the X electrode 104 in each discharge cell. A first edge 117*a* of the Y electrode visible absorbing layer 117 may be aligned with a first edge 105*a* of the Y electrode 105 in each discharge cell.

The first edges 104*a* and 105*a* of the discharge sustaining electrode pairs 103 may be aligned with the first edges 116*a* and 117*a* of the visible ray absorbing layers 115 in order to ensure an aperture ratio, which may be reduced due to presence of the visible ray absorbing layer 115 in each discharge cell, to reduce reflectivity with respect to external light, and to improve the brightness of the PDP 100 due to the reflective effect obtained by providing the discharge sustaining electrode pairs 103.

The width W3 of the X electrode visible ray absorbing layer 116 and the width W4 of the Y electrode visible absorbing layer 117 may be greater than the width W1 of the corresponding X electrode 104 and the width W2 of the corresponding Y electrode 105, respectively.

That is, the X electrode visible ray absorbing layer 116 and the Y electrode visible absorbing layer 117 may extend towards the non-discharge region 106 so as to have greater widths than the widths of the X electrode 104 and the Y electrode 105, respectively. In an embodiment, in the PDP 100, a second edge 116*b* of the X electrode visible ray absorbing layer 116 and a second edge 117*b* of the Y electrode visible absorbing layer 117, which may be related to different, adjacent discharge cells, may be disposed in the same non-discharge region 106.

Alternatively, the visible ray absorbing layers 115 may overlie the X electrode 104 and Y electrode 105, corresponding to different, adjacent discharge cells. The visible ray absorbing layers 115 may be integrated to completely overlie the non-discharge region 106. Likewise, the embodiments are not limited as long as the width of the X electrode visible ray absorbing layer 116 and the width of the Y electrode visible absorbing layer 117 are wider than the width of the corresponding X electrode 104 and the width of the corresponding Y electrode 105, respectively.

The visible ray absorbing layers 115 may include, e.g., an absorptive material having high absorbance with respect to visible rays, i.e., a material having reflectivity equal to or less than about 10% with respect to visible rays, in order to absorb external light and reduce reflectively. The visible ray absorbing layers 115 may include, e.g., an absorptive material exhibiting dark color and glass. The visible ray absorbing layers 115 may have a black color. The visible ray absorbing layers 115 may be formed from a dielectric paste containing black pigment, e.g., CrO and $FeCr_2O_4$. However, the embodiments are not limited thereto as long as the reflectivity with respect to visible rays is equal to or less than about 10%.

A method of manufacturing the PDP 100 having the above structure, according to an embodiment, will be described with reference to FIGS. 3A to 3H.

First, the first substrate 101 may be prepared. The first substrate 101 may be a substrate through which visible rays are transmitted. The first substrate 101 may be a transparent substrate including, e.g., soda lime glass, etc.

A visible ray absorbing layer raw material 201, which will form the visible ray absorbing layers 115, may be coated on a surface of the first substrate 101. The visible ray absorbing layer raw material 201 may include a dark material and a glass powder. The dark material may have a black color. The dark material may include, e.g., a dielectric paste containing black pigment, e.g., CrO and $FeCr_2O_4$. The visible ray absorbing layer raw material 201 may have reflectivity equal to or less than about 10% with respect to visible rays in order to absorb external light.

The visible ray absorbing layer raw material 201 may constitute a black firing film having a dense layer by forming the first substrate by using, e.g., a screen printing method, a coater method, etc., on the first substrate 101, and then performing drying and firing operations.

Then, a reflective layer raw material 202 may be coated on a surface of the visible ray absorbing layer raw material 201, which may then be fired. The reflective layer raw material 202 may be formed of, e.g., aluminum, gold, silver, tungsten, chromium, nickel and an alloy including, e.g., aluminum, gold, silver, tungsten, chromium, and nickel. The reflective layer raw material 202 may have reflectivity equal to or greater than about 80 % with respect to visible rays.

Figure 3A:
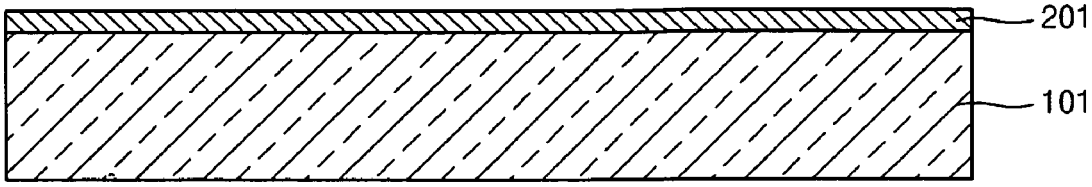
FIGS. 3A to 3H illustrate stages in a method of manufacturing a PDP according to an embodiment.
Figure 3B:
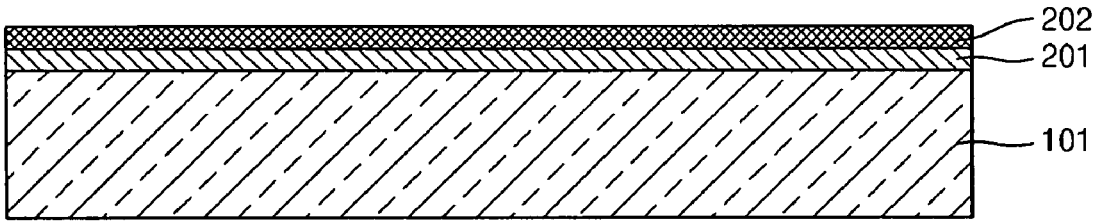

The reflective layer raw material 202 may be formed on an entire surface of the visible ray absorbing layer raw material 201 by using a coating method, e.g., deposition or sputtering. The reflective layer raw material 202 may be formed to a thickness of about 1 to about 2 micrometers. (FIG. 3B)

Figure 3C:
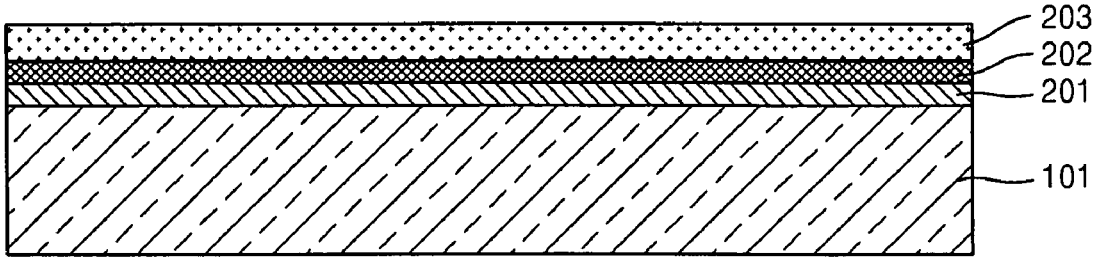

Then, a first photoresist 203 may be coated on the reflective layer raw material 202 and dried. (FIG. 3C)

Figure 3D:
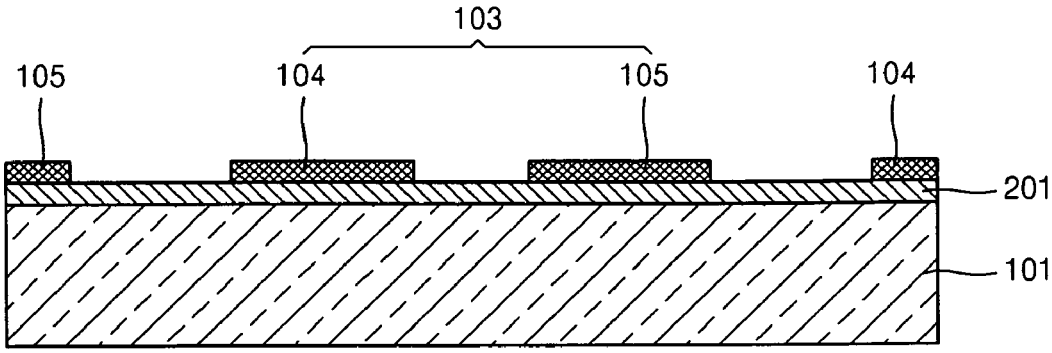

The X electrode 104 and the Y electrode 105, having desired patterns, may be formed by exposing the first photoresist 203 through a photo mask having a pattern corresponding to the X electrode 104 and the Y electrode 105 so as to pattern the first photoresist 203 in shapes of the X electrode 104 and the Y electrode 105. Then, the first photoresist 203 may be developed using a developer, and then etching the first photoresist 203 using an etching solution suitable for etching a metal material constituting the reflective layer raw material 202. (FIG. 3D)

Figure 3E:
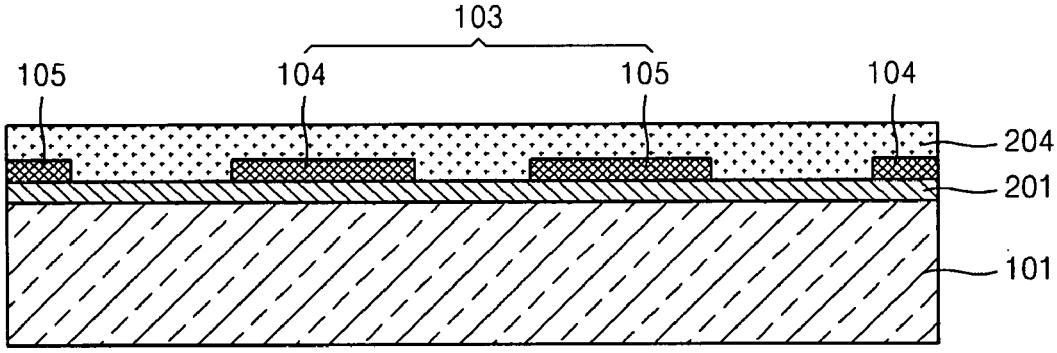

Then, a second photoresist 204 may be coated and dried so as to cover the X electrode 104 and the Y electrode 105. (FIG. 3E)

The X electrode visible ray absorbing layer 116 and the Y electrode visible absorbing layer 117, having desired patterns, may be formed by exposing the second photoresist 204 through a photo mask having a pattern corresponding to the X electrode visible ray absorbing layer 116 and the Y electrode visible absorbing layer 117, so as to pattern the second photoresist 204 in shapes of the X electrode visible ray absorbing layer 116 and the Y electrode visible absorbing layer 117. Then the second photoresist 204 may be developed using a developer, and then etching the second photoresist 204 by using an etching solution suitable for etching a dielectric material constituting the visible ray absorbing layer raw material 201.

Accordingly, the X electrode visible ray absorbing layer 116 and the Y electrode visible absorbing layer 117, constituting a first layer, may be formed on the inner surface of the first substrate 101. The X electrode 104 and the Y electrode 105, constituting a second layer, may be formed on a surface of the X electrode visible ray absorbing layer 116 and a surface of the Y electrode visible absorbing layer 117, respectively.

The first edge 116*a* of the X electrode visible ray absorbing layer 116 and the first edge 117*a* of the Y electrode visible absorbing layer 117 may align with the first edge 104*a* of the X electrode 104 and the first edge 105*a* of the Y electrode 105 in each discharge cell, respectively.

Figure 3F:
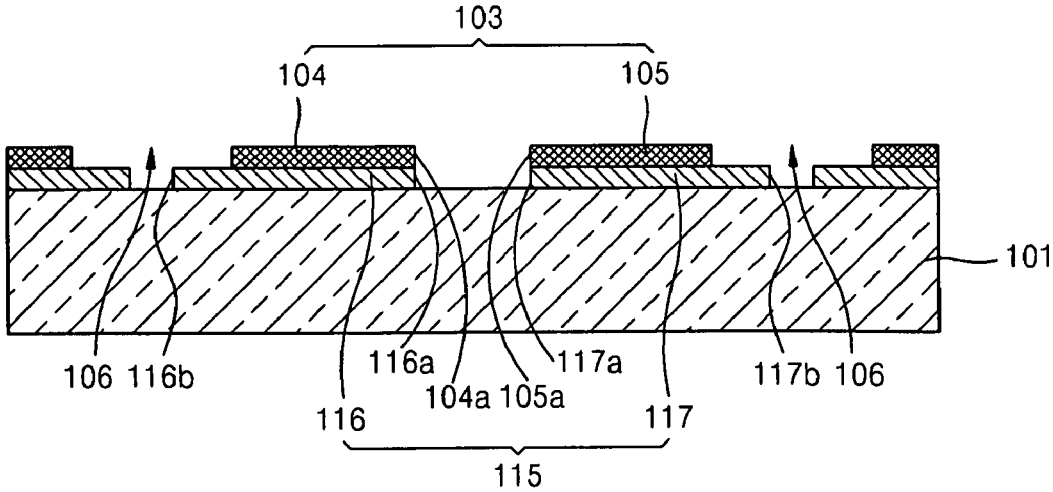

The X electrode visible ray absorbing layer 116 and the Y electrode visible absorbing layer 117 may extend towards the non-discharge region 106 so as to be wider than the X electrode 104 and the Y electrode 105, respectively. (FIG. 3F)

Then, the first dielectric layer 107 may cover the X electrode visible ray absorbing layer 116 and the X electrode 104 and the Y electrode visible absorbing layer 117 and the Y electrode 105.

Figure 3G:
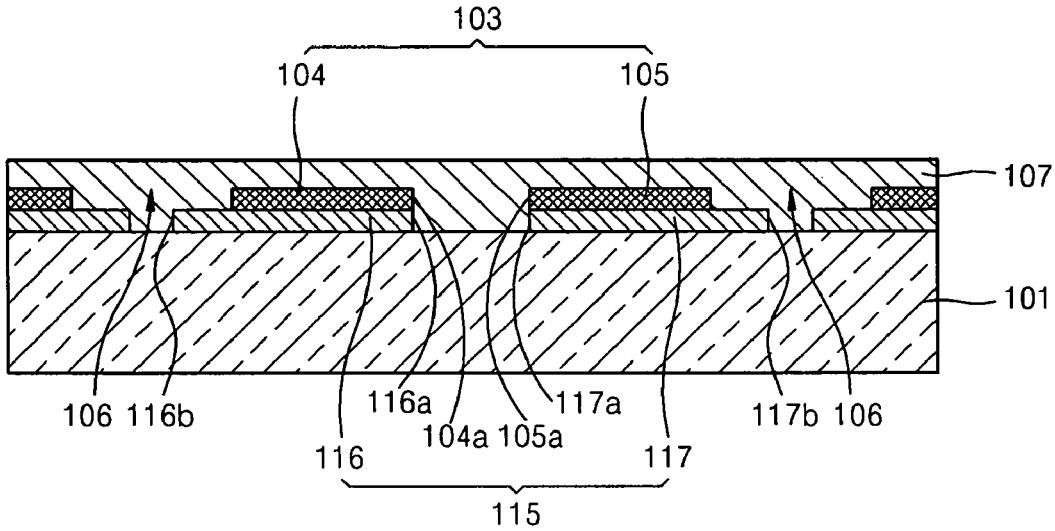

The first dielectric layer 107 may include a dielectric material, e.g., a glass paste containing various fillers. The first dielectric layer 107 may be formed by coating a dielectric material by using, e.g., a screen printing method, a coater method, etc., and then performing drying and firing operations. (FIG. 3G)

Then, the protective layer 108 including, e.g., magnesium oxide (MgO), may be formed on a surface of the first dielectric layer 107.

Figure 3H:
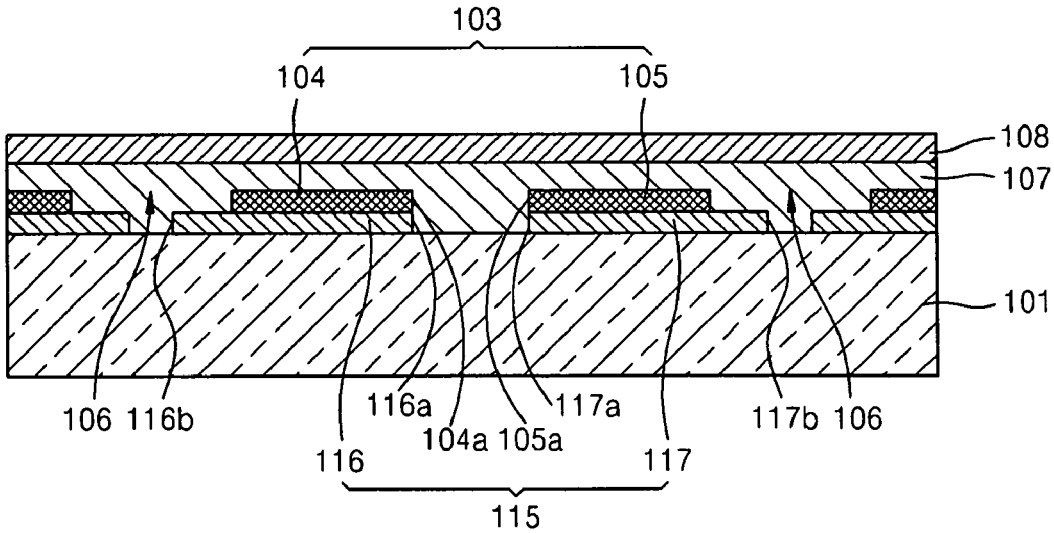

Accordingly, a two-layer structure, in which the visible ray absorbing layer 115 and the discharge sustaining electrode pair 103 functioning as a reflective layer may be sequentially formed, may be formed on the first substrate 101. (FIG. 3H)

Figure 4:
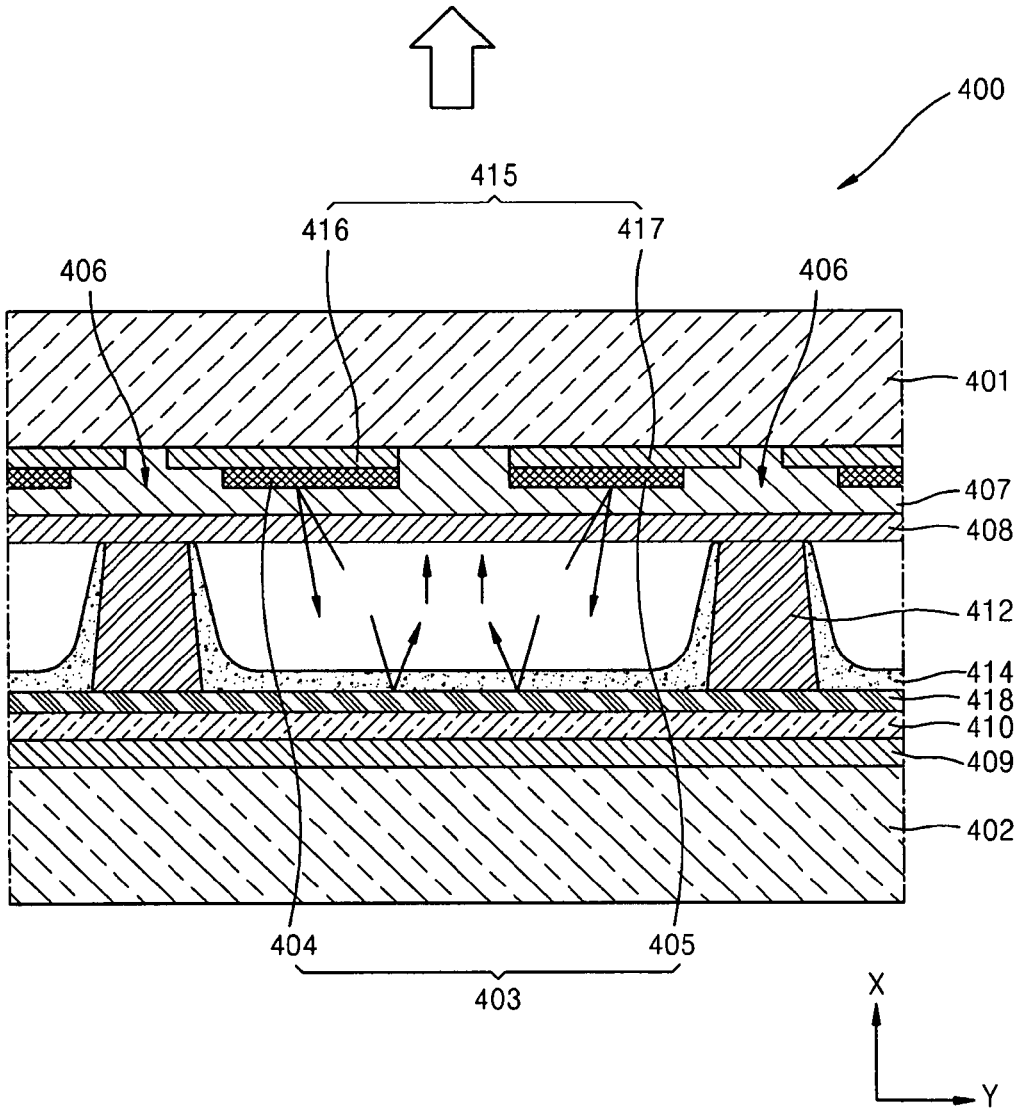
FIG. 4 illustrates a cross-sectional view of a PDP according to another embodiment.

FIG. 4 illustrates a cross-sectional view of a PDP 400 according to another embodiment.

Referring to FIG. 4, the PDP 400 may include a first substrate 401 and a second substrate 402 facing the first substrate 401. A visible ray absorbing layer 415 including an X electrode visible ray absorbing layer 416 and a Y electrode visible ray absorbing layer 417 may be disposed on an inner surface of the first substrate 401. Discharge sustaining electrode pairs 403 including an X electrode 404 and a Y electrode 405 may be disposed on a surface of the X electrode visible ray absorbing layer 416 and a surface of the Y electrode visible ray absorbing layer 417.

The visible ray absorbing layer 415 and the discharge sustaining electrode pairs 403 may be covered by a first dielectric layer 407. A protective layer 408 may be formed on a surface of the first dielectric layer 407.

An address electrode 409 may be disposed on an inner surface of the second substrate 402. The address electrode 409 may be covered by a second dielectric layer 410. Barrier ribs 412 may be formed between the first substrate 401 and the second substrate 402 to define discharge cells together with the first substrate 401 and the second substrate 402. Red, green, and blue phosphor layers 414 may be coated in the discharge cell defined by the barrier ribs 412. A discharge gas, e.g., neon (Ne)-xenon (Xe) or helium (He)-xenon (Xe), may be injected into the discharge cells.

In this embodiment, a reflective layer 418 may be further formed on the second substrate 402. That is, the reflective layer 418 having reflectivity equal to or greater than about 80 % from the second substrate 402 towards the first substrate 401, may be formed between the second dielectric layer 410 and the red, green, and blue phosphor layers 414. The reflective layer 418 may include a reflective material, e.g., a white dielectric material, e.g., $Al_2O_3$ or $TiO_2$, or a metal material, e.g., an Al thin film, so that visible rays generated by the discharge cells may be reflected towards a discharge gap of the first substrate 401 rather than be transmitted through the second substrate 402.

Alternatively, the reflective layer 418 may be formed between the barrier ribs 411 and the red, green, and blue phosphor layers 414 as well as between the second dielectric layer 410 and the red, green, and blue phosphor layers 414. The embodiments are not limited as long as visible rays generated by the discharge cells may be reflected towards the discharge gap of the first substrate 401.

As described above, a PDP according to an embodiment may obtain the following effects.

First, since an entire region of the PDP, excluding a discharge gap, may be covered by a visible ray absorbing layer, viewed from the front, the amount of external light reflected by the PDP may be remarkably reduced.

Second, since visible rays generated by exciting a phosphor material of a phosphor layer may be reflected by discharge sustaining electrode pairs functioning as a reflective layer and then may be emitted through a discharge gap, which may be the only passage in a discharge cell, loss in brightness may be remarkably reduced.

Third, since a reflective layer may be further formed below the phosphor layers, visible rays generated from a panel may be repeatedly reflected and emitted via a discharge gap, thereby improving bright room contrast.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate and a second substrate, the first substrate having an inner surface facing the second substrate;

at least one dark-colored visible ray absorbing layer on the inner surface of the first substrate;

a plurality of discharge sustaining electrode pairs on the visible ray absorbing layer;

a first dielectric layer on the discharge sustaining electrode pair;

an address electrode on the second substrate and disposed in a direction crossing the discharge sustaining electrode pair;

a second dielectric layer on the address electrode;

barrier ribs disposed between the first substrate and the second substrate and defining a plurality of discharge cells; and a phosphor layer coated in the discharge cells, wherein:

the plurality of discharge sustaining electrode pairs each have at least a pair of electrodes, at least one discharge sustaining electrode pair being adjacent to another discharge sustaining electrode pair, and a non-discharge region defined by a space between one discharge sustaining electrode pair and the other adjacent discharge sustaining electrode pair, and the visible ray absorbing layer and the discharge sustaining electrodes each have a width, the width of the visible ray absorbing layer being greater than the width of each discharge sustaining electrode, and each visible ray absorbing layer and each discharge sustaining electrode of a discharge sustaining electrode pair include a first edge, and wherein the first edge of the visible ray absorbing layer is aligned with the first edge of the discharge sustaining electrode in one of the discharge cells.

2. The PDP as claimed in claim 1, wherein the visible ray absorbing layer is disposed directly on the inner surface of the first substrate and the discharge sustaining electrode pair is disposed directly on the visible ray absorbing layer.

3. The PDP as claimed in claim 2, wherein each discharge sustaining electrode pair includes an X electrode and a Y electrode in one of the discharge cells, and the visible ray absorbing layer includes an X electrode visible ray absorbing layer and a Y electrode visible ray absorbing layer corresponding to the X electrode and the Y electrode, respectively.

4. The PDP as claimed in claim 3, wherein the X electrode and the Y electrode extend in a direction crossing the address electrode and an adjacent discharge cell, and the X electrode visible ray absorbing layer and the Y electrode visible ray absorbing layer overlie the X electrode and the Y electrode, and extend in the same direction as the X electrode and the Y electrode.

5. The PDP as claimed in claim 1, wherein the visible ray absorbing layer has a black color and includes glass.

6. The PDP as claimed in claim 1, wherein the discharge sustaining electrode pair includes at least one of aluminum, gold, silver, tungsten, chromium, nickel and an alloy including at least one of aluminum, gold, silver, tungsten, nickel, and chromium.

7. The PDP as claimed in claim 1, wherein:

each discharge sustaining electrode pair includes an X electrode and a Y electrode in a discharge cell, and the visible ray absorbing layer overlies the non-discharge region and the X electrode and Y electrode in different, adjacent discharge cells.

8. The PDP as claimed in claim 1, further comprising a reflective layer on the second substrate.

9. A PDP, comprising:

a substrate having an inner surface;

a dark-colored visible ray absorbing layer on the inner surface of the substrate;

a reflective layer on the visible ray absorbing layer;

a dielectric layer on the reflective layer; and a discharge space adjacent to the dielectric layer, wherein:

the dark-colored visible ray absorbing layer and the reflective layer each have a width, and the width of the visible ray absorbing layer is greater than the width of the reflective layer, the discharge space includes barrier ribs partitioning the discharge space into discharge cells, the reflective layer extends in a direction to cross adjacent discharge cells, the visible ray absorbing layer overlies the reflective layer and extends in the same direction as the reflective layer, the visible ray absorbing layer and the reflective layer are stacked in a two-layer structure, and the visible ray absorbing layer and the reflective layer each have a first edge, and the first edge of the visible ray absorbing layer is aligned with the first edge of the reflective layer in the discharge cells.

10. The PDP as claimed in claim 9, wherein the reflective layer faces the discharge space and includes a reflective conductive material to which a predetermined discharge voltage is applied.

11. The PDP as claimed in claim 10, wherein the reflective layer includes at least one of aluminum, gold, silver, tungsten, chromium, nickel and an alloy including at least one of aluminum, gold, silver, tungsten, nickel, and chromium.

12. The PDP as claimed in claim 9, wherein the visible ray absorbing layer has a black color and includes glass.

* * * * *